US011919704B1

(12) United States Patent
Sauer

(10) Patent No.: US 11,919,704 B1
(45) Date of Patent: Mar. 5, 2024

(54) CONTAINER ASSEMBLY FOR STORING FOOD, MEDICINES, ELECTRONICS, TOYS, OR OTHER CONSUMABLES OR ITEMS

(71) Applicant: Marcus Sauer, Springfield, IL (US)

(72) Inventor: Marcus Sauer, Springfield, IL (US)

( * ) Notice: Subject to any disclaimer, the term of this patent is extended or adjusted under 35 U.S.C. 154(b) by 0 days.

(21) Appl. No.: 17/590,494

(22) Filed: Feb. 1, 2022

(51) Int. Cl.
*B65D 88/12* (2006.01)
*B65D 21/02* (2006.01)
*B65D 90/00* (2006.01)

(52) U.S. Cl.
CPC ..... *B65D 88/12* (2013.01); *B65D 21/0212* (2013.01); *B65D 90/008* (2013.01)

(58) Field of Classification Search
CPC .... E05G 1/026; A01K 1/0272; A01K 1/0035; A01K 1/0236; B62B 1/24; B65D 88/12
USPC ..... 119/482
See application file for complete search history.

(56) References Cited

U.S. PATENT DOCUMENTS 3,710,761 A * 1/1973 Gregory ..... A01K 1/0245 220/4.24
3,771,686 A 11/1973 Brison
5,253,612 A * 10/1993 Goetz ..... A01K 1/0245 119/497
5,551,371 A * 9/1996 Markey ..... A01K 1/033 119/482
6,182,611 B1 * 2/2001 Marchioro ..... A01K 1/0245 D30/114
7,458,337 B2 12/2008 Callan
8,544,417 B2 * 10/2013 Sangl ..... A01K 1/0245 119/482
9,370,165 B2 6/2016 de Brien
9,788,524 B2 * 10/2017 Veness ..... A01K 1/0236
10,334,815 B1 * 7/2019 Edmonds ..... B62B 1/24
10,517,263 B1 * 12/2019 Perez ..... A01K 1/011
11,399,504 B1 * 8/2022 Edmonds ..... A01K 1/0035
2003/0213438 A1 11/2003 Saxe et al.
(Continued)

FOREIGN PATENT DOCUMENTS

DE 202010013090 U1 3/2011
DE 202010013090 U1 * 4/2011 ..... E05G 1/005
WO 2017012914 1/2017

OTHER PUBLICATIONS www.lockabox.com.

*Primary Examiner* — Ernesto A Grano
*Assistant Examiner* — Symren K Sanghera
(74) *Attorney, Agent, or Firm* — John Rizvi; John Rizvi, P.A.—The Patent Professor®

(57) ABSTRACT

A container assembly for storing or transporting items, such as food, medicines, electronics, toys, cash, etc., in an organized and secure manner, may include a first body portion and a second body portion forming a main body of the container and defining a container interior. The container interior may be sized and configured to receive and contain items. A plurality of clip fasteners may be provided on the first body portion and the second body portion for securing the second body portion to the first body portion. The container assembly may include a container door, which may be opened and closed to respectively allow or prevent access to the container interior. At least one container securing feature may be provided on the first body portion and/or the second body portion for securing the container assembly in a transport vehicle or a refrigerator, freezer, cooler or other storage receptacle or facility.

13 Claims, 8 Drawing Sheets

(56) References Cited

U.S. PATENT DOCUMENTS

| | | | | |
|---|---|---|---|---|
| 2010/0043720 | A1 | 2/2010 | Yelverton | |
| 2010/0192870 | A1* | 8/2010 | Wood | A01K 1/0245 29/428 |
| 2011/0220033 | A1* | 9/2011 | Sangl | A01K 1/0245 119/455 |
| 2014/0150728 | A1* | 6/2014 | Tamiozzo | A01K 1/0236 119/501 |
| 2015/0034018 | A1* | 2/2015 | Edmonds | A01K 1/0245 119/496 |
| 2018/0288964 | A1* | 10/2018 | Tamiozzo | A01K 1/0245 |
| 2018/0317682 | A1* | 11/2018 | Nguyen | B65D 23/14 |
| 2019/0320613 | A1* | 10/2019 | Björnetun | A01K 1/0064 |
| 2021/0331195 | A1* | 10/2021 | Pressey | F16L 58/02 |
| 2022/0234811 | A1* | 7/2022 | Deng | A47J 41/0072 |

* cited by examiner

CONTAINER ASSEMBLY FOR STORING FOOD, MEDICINES, ELECTRONICS, TOYS, OR OTHER CONSUMABLES OR ITEMS

FIELD OF THE INVENTION

The present invention relates generally to containers, and more particularly, to a container assembly which can be used to contain, store, and transport food items in an organized and secure manner.

BACKGROUND OF THE INVENTION

Various types of containers are known for containing and carrying items such as, but not limited to, food, medicines, electronics, toys, cash, etc. For example, food items obtained at grocery stores are most frequently contained in boxes, cartons, bottles, bags and like containers. During shopping, the containers are individually retrieved from shelves and typically placed into a wheeled grocery cart or a hand-carried basket. At checkout, the containers may be removed from the cart or basket, scanned, and placed in paper or plastic bags. After scanning of the containers is completed, the bags may be carried, for instance, to a vehicle or initially placed back into the grocery cart or basket and then transported to the vehicle in the cart or basket. At the vehicle, the bags may be removed from the cart or basket and placed in the vehicle for transport of the bags to a home, business or other building or destination.

After they are scanned, the food items may be placed haphazardly in the bags in a disorganized manner. Hence, frozen food items and perishable items may be placed in the same bags. Moreover, during transport in the vehicle, the bags may have a tendency to slide, fall over and discharge their contents, particularly in the event that the vehicle accelerates or stops abruptly or turns sharp corners. Consequently, the containers which contain the purchased food items may need to be gathered and placed back into the bags prior to carrying of the bags from the vehicle into the house or other building. Fruits, vegetables, meats and other perishable items may be removed from the bags and placed into a refrigerator or freezer.

Refrigerators used in households, offices, medical facilities, or other locations may include various compartments into which food items may be placed for later retrieval and consumption. The compartments may be used to separate meats from fruits from vegetables and fruits and vegetables from each other. However, the compartments typically may be accessed by any person who has access to the refrigerator. Thus, the food items may be removed and consumed without authorization and may become cluttered and disorganized over time. In certain medical settings, it may be particularly relevant to safely store food items inside a refrigerator such that the chances of theft or uncontrolled consumption by patients or other subjects are minimized.

Some containers known in the art may include locking mechanisms to prevent unauthorized access to the container contents. For example, a lock may be included in a container configured to store medicines, cash, electronics, and/or other valuable or potentially hazardous items. Such containers, however, are often costly and therefore not as accessible to the public as would be desired.

Accordingly, there is need for a container assembly which solves at least one of the aforementioned problems. For example, there is a need for a container assembly which can be used to contain and store or transport consumables or items in an organized and secure manner. It is also desirable to obtain a container assembly which can be manufactured cost effectively and yet provides high structural resistance and safety to the items contained therein.

SUMMARY OF THE INVENTION

The present invention is directed to a container assembly which can be used to contain, store, or transport consumables or other items such as, but not limited to, food, medicines, electronics, toys, or cash, in an organized and secure manner. An illustrative embodiment of the container assembly may include a first body portion. A second body portion may be provided on the first body portion. In some preferred embodiments, the first and second body portion may be identical. A container interior may be formed by and between the first body portion and the second body portion. The container interior may be sized and configured to receive and contain one or more items. A plurality of clip fasteners may be provided on the first body portion and the second body portion. The clip fasteners may be configured to engage each other to secure the second body portion to the first body portion. A container door may be supported by the first body portion and the second body portion. The container door may be selectively deployable to open and close the container interior. At least one container securing feature may be provided on the first body portion and/or the second body portion. The container securing feature may be configured to secure the container assembly in a transport vehicle or a refrigerator, freezer, cooler or other storage receptacle or facility.

In a first implementation of the invention, a container assembly configured to contain, store, or transport items in an organized and secure manner comprises a first body portion and a second body portion mountable to the first body portion. Each one of the first body portion and second body portion may include a respective plurality of clip fasteners. Each clip fastener of the plurality of clip fasteners of the first body portion may be configured to elastically engage a respective clip fastener of the plurality of clip fasteners of the second body portion. The container assembly may further include a container door. The container assembly may be configured to adopt an assembled configuration in which the first body portion is mounted on the second body portion and secured to the second body portion by engagement between the plurality of clip fasteners of the first body portion and the plurality of fasteners of the second body portion. In the assembled configuration, a container interior may be formed by and between the first body portion and the second body portion. The container interior may be configured to receive and contain at least one item. Also in the assembled configuration, the container door may be pivotably attached to the first and second body portions and may be pivotable between open and closed positions respectively allowing and preventing access to the container interior.

In a second aspect, the clip fasteners of the first body portion may be arranged in spaced-apart configuration along one or more sidewalls of the first body portion. The clip fasteners of the second body portion may be arranged in spaced-apart configuration along one or more sidewalls of the second body portion.

In another aspect, the clip fasteners of the first body portion may be formed on an inner side of the one or more sidewalls of the first body portion, and the clip fasteners of the second body portion may be formed on an inner side of the one or more sidewalls of the second body portion. The clip fasteners of the first and second body portions may be concealed when the container assembly is arranged in the assembled configuration.

In another aspect, each clip fastener of the plurality of clip fasteners of the first body portion may include one of a clip and a clip retaining frame configured to engage with each other. The respective clip fastener of the plurality of clip fasteners of the second body portion may include the other one of the clip and the clip retaining frame.

In another aspect, the clip retaining frame may include a frame opening, and the clip may include a clip flange which may elastically snap into the frame opening of the clip retaining frame in engagement of the clip with the clip retaining frame.

In yet another aspect, each clip fastener of the plurality of clip fasteners of the first body portion may include a clip and a clip retaining frame. The respective clip fastener of the plurality of clip fasteners of the second body portion may include a clip retaining frame and a clip. The clip and clip retaining frame of each clip fastener of the plurality of clip fasteners of the first body portion may be configured to engage, respectively, with the clip retaining frame and clip of the respective clip fastener of the plurality of clip fasteners of the second body portion.

In another aspect, the container assembly may further include at least one container securing feature on at least one of the first body portion and the second body portion. The container securing feature(s) may be configured to engage with an external structure for securing container assembly to the external structure.

In another aspect, the container securing feature(s) may include a plurality of through holes in at least one of the first body portion and the second body portion.

In another aspect, the plurality of through holes may be provided in both the first body portion and the second body portion.

In yet another aspect, the container securing feature(s) may include a plurality of securement cutouts formed at a junction between the first body portion and the second body portion in the assembled configuration.

In another aspect, the container assembly may be stackable with an identical, second container assembly to adopt a stacked configuration.

In another aspect, the container assembly may further include a container stabilization feature provided on at least one of the first body portion and the second body portion. The container stabilization feature may at least partially block a relative horizontal movement between the container assembly and second container assembly in the stacked configuration.

In another aspect, the container stabilization feature may include one or more protrusions formed on one of a base panel of the first body portion and a base panel of the second body portion, and one or more recesses formed on the other of the base panel of the first body portion and the base panel of the second body portion. In the assembled configuration of the container assembly, each protrusion may be vertically aligned with a respective recess. In the stacked configuration of the container assembly and second container assembly, the base panel of the first body portion of the container assembly may be stacked on the base panel of the second body portion of the second container assembly and the one or more protrusions and recesses of the base panels may be engaged at least partially blocking a relative horizontal movement between the stacked container assembly and second container assembly.

In yet another aspect, the container stabilization feature may include one or more protrusions and one or more recesses formed on a base panel of the first body portion, and one or more recesses and one or more protrusions formed on a base panel of the second body portion. In the assembled configuration of the container assembly, each protrusion of the base panel of the first body portion may be vertically aligned with a respective recess of the base panel of the second body portion and each recess of the base panel of the first body portion may be vertically aligned with a respective protrusion of the base panel of the second body portion. In the stacked configuration of the container assembly and second container assembly, the base panel of the first body portion of the container assembly may be stacked on the base panel of the second body portion of the second container assembly, and each recess and each protrusion of the base panel of the first body portion of the container assembly may be respectively engaged with a respective protrusion and a respective recess of the base panel of the second body portion of the second container assembly at least partially blocking relative horizontal movement between the stacked container assembly and second container assembly.

In another aspect, each of the first and second body portions may include a base panel, a pair of spaced-apart side panels extending from the base panel and a rear panel extending from the base panel between the side panels. The side panels and the rear panel of the second body portion may be configured to mate with the side panels and rear panel of the first body portion.

In another aspect, the container assembly may further include one or more interconnecting members extending between the first body portion and the second body portion. Each interconnecting member may be formed as a separate part and may be attached to the first and second body portions in the assembled configuration of the container assembly.

In another aspect, the container door may include a door lock comprising a lock latch. The lock latch may be configured to engage one of the one or more interconnecting members in a locking configuration to lock the container door in a closed position. The door latch may be further configured to disengage the interconnecting member in an unlocking configuration to unlock the container door.

In yet another aspect, the first body portion and second body portion may be identical.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The present invention is directed toward a container assembly which can be used to contain and store or transport consumables or other items, such as, but not limited to, food, medicines, electronics, toys, or cash, in an organized and secure manner. In some embodiments, the container assembly may be advantageously used to store sensitive and/or valuable items.

Figure 1:
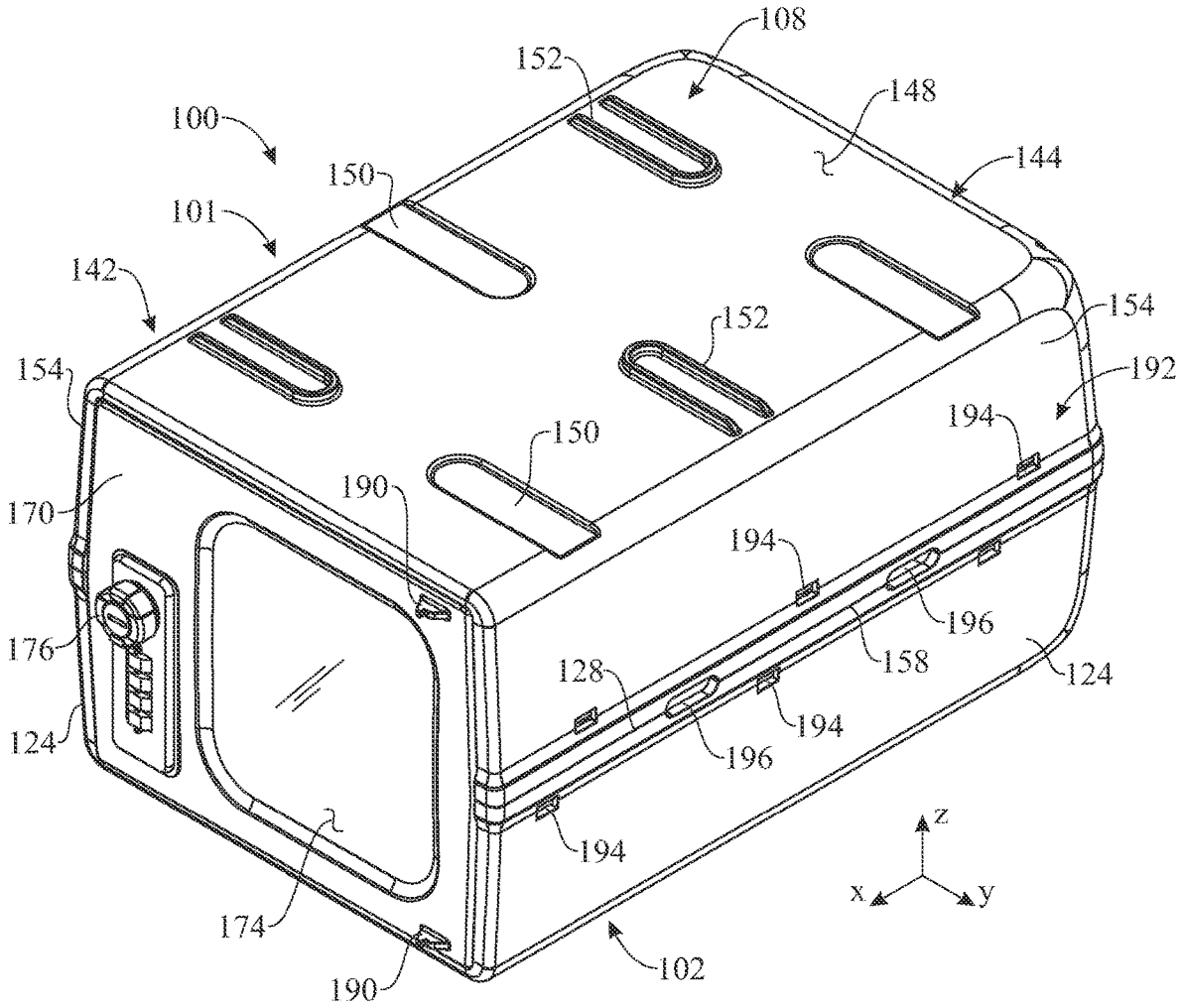
FIG. 1 presents a top front isometric view of a container assembly in accordance with an illustrative embodiment of the present invention.
Figure 8:
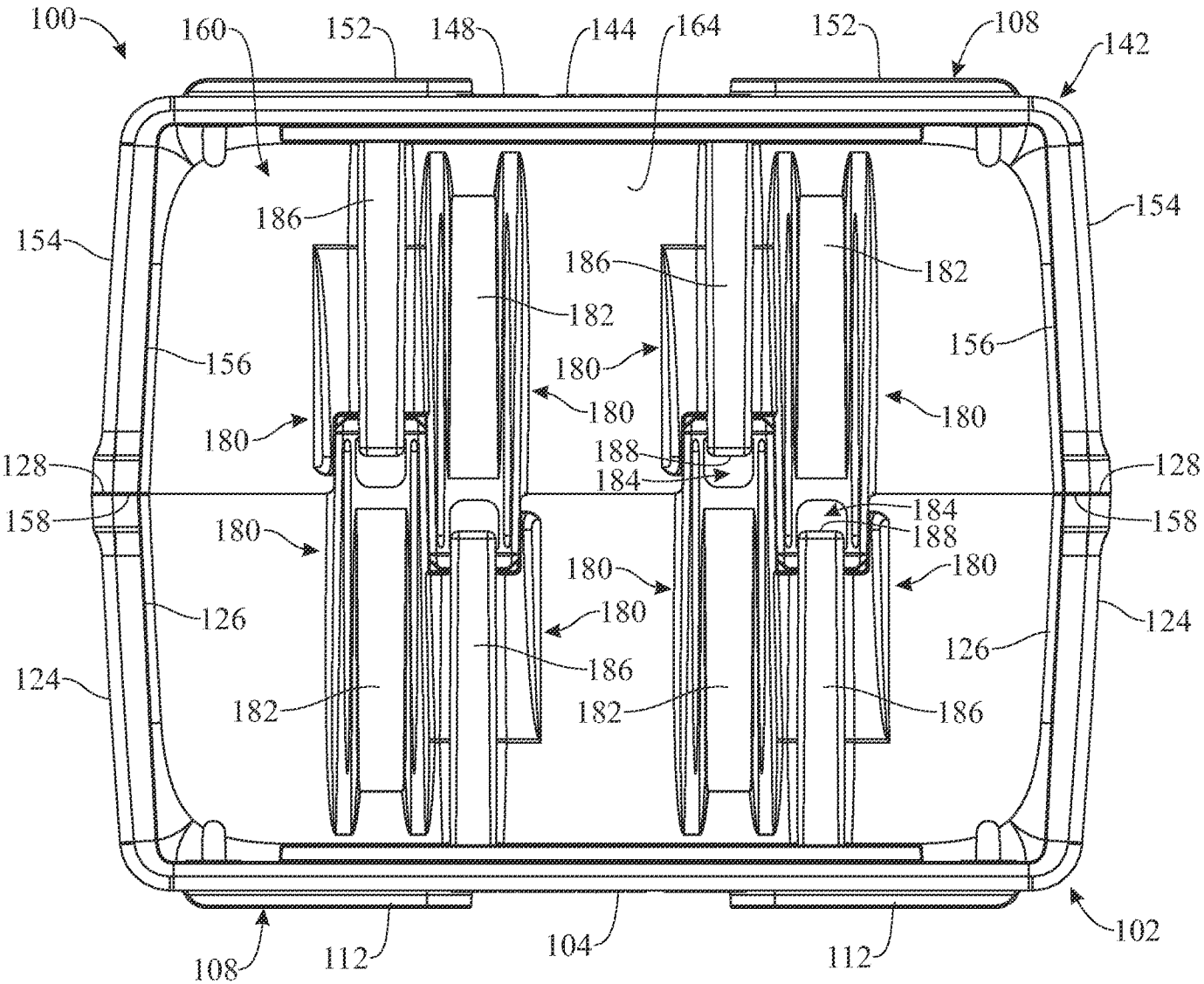
FIG. 8 presents a front elevation view of a rear wall of the container assembly, showing the clip fasteners of the first and second body portions engaged and securing the first and second body portions to one another.

Referring initially to FIG. 1, a container assembly 100 is illustrated in accordance with an exemplary embodiment of the present invention. The container assembly 100 comprises a main body 101, which may be formed of a first body portion 102 and a second body portion 142. The first body portion 102 may provide or constitute a base of the main body 101, and the second body portion 142 may be provided as a cover on the first body portion 102. As illustrated in FIG. 8, a container interior 160 may be formed by and between the first body portion 102 and the second body portion 142. The container interior 160 may be sized and configured to contain one or more items (not illustrated) such as, but not limited to, food, medicines, electronics, toys, or cash. As will be described in greater detail hereinafter, in preferred embodiments, such as the present embodiment, the first and second body portions 102 and 142 may be identical; i.e., when the container assembly 100 is assembled the second body portion 142 and first body portion 102 are identical parts, only positioned vertically inverted one relative to the other. Having identical first and second body portions 102 and 142 allows to increase cost-effectiveness. For example, the first and second body portions 102 and 142 may be manufactured by plastics injection molding using a same mold.

Figure 2:
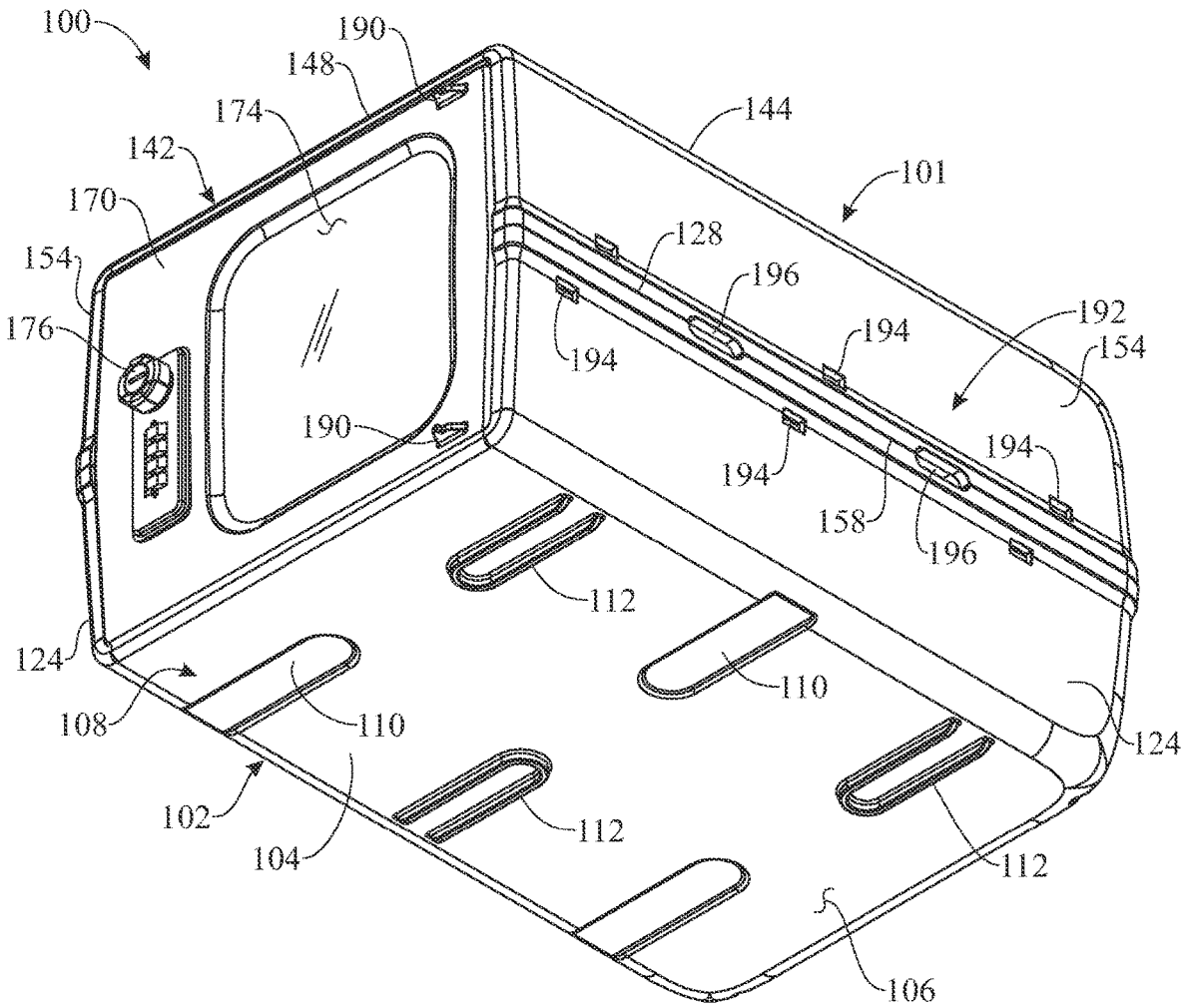
FIG. 2 presents a bottom front isometric view of the container assembly of FIG. 1.
Figure 3:
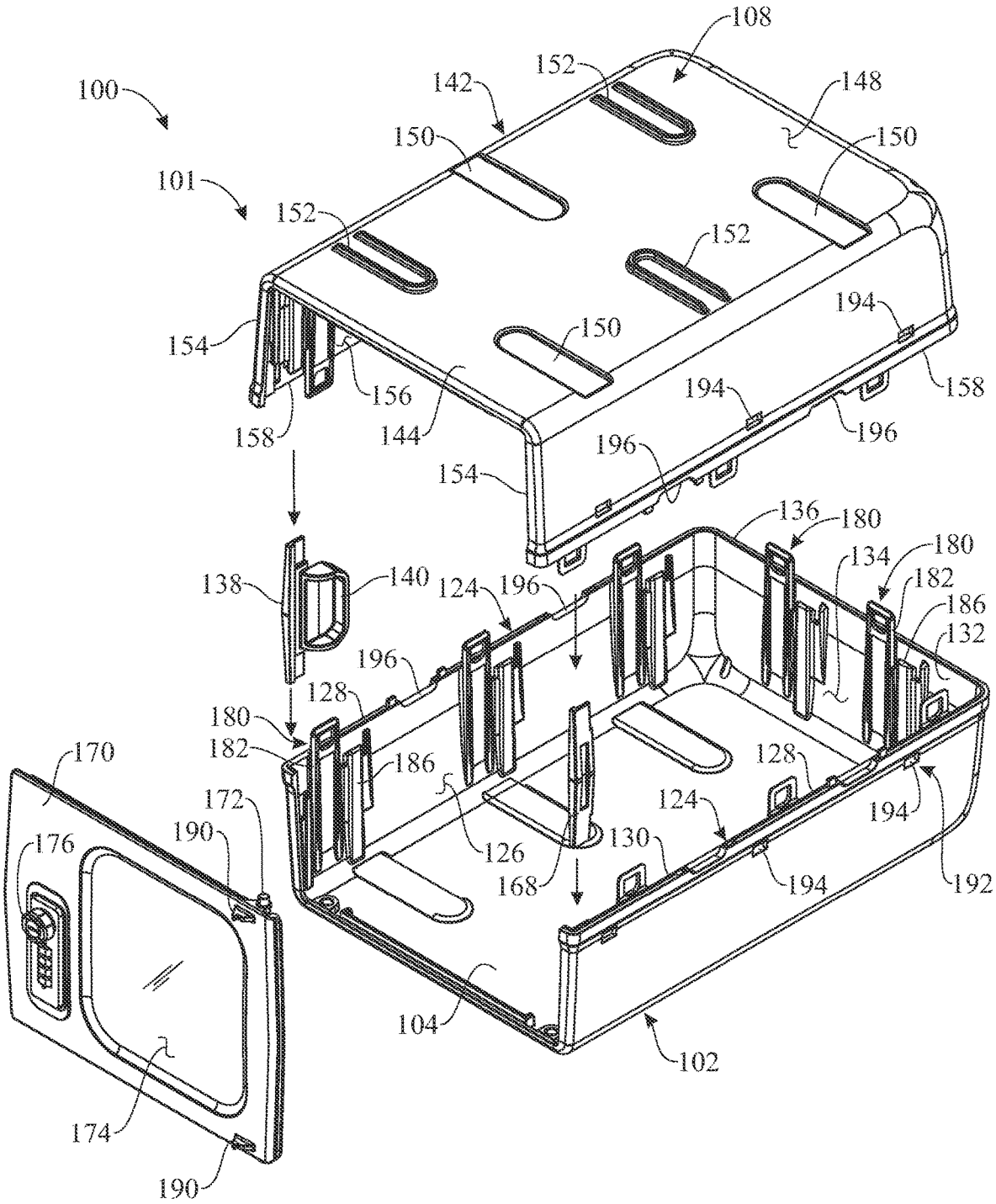
FIG. 3 presents an exploded top front isometric view of the illustrative container assembly of FIG. 1.
Figure 4:
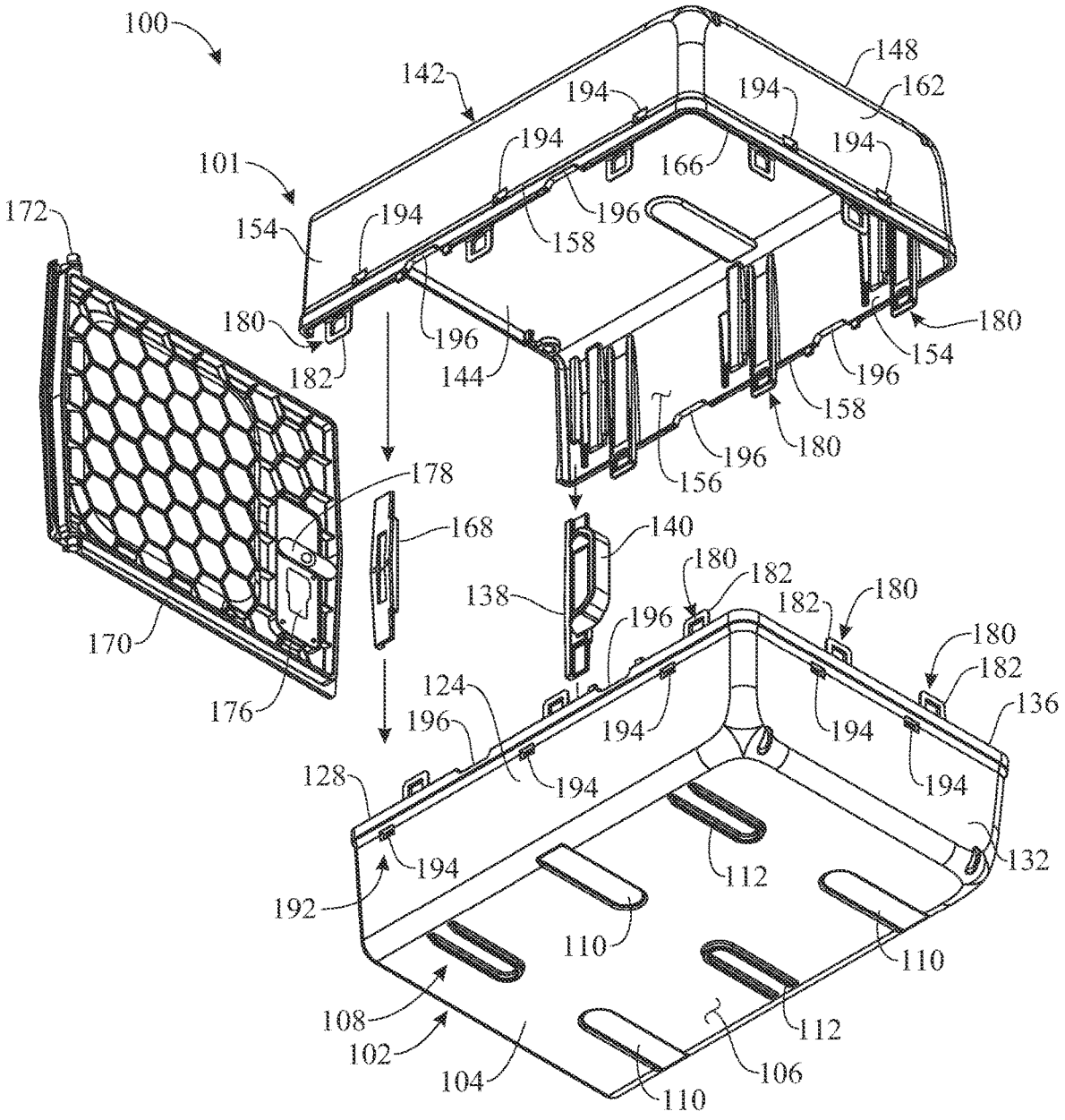
FIG. 4 presents an exploded, bottom rear isometric view of the container assembly of FIG. 1.

As shown in FIGS. 3 and 4, a plurality of elastic clip fasteners, hereinafter referred to as clip fasteners 180, may be provided on the first body portion 102 and the second body portion 142. The clip fasteners 180 may be configured to engage each other to secure the second body portion 142 to the first body portion 102. Preferably, the clip fasteners 180 are formed on an inner side of the first and second body portions 102 and 142 such that the clip fasteners 180 are not visible when the first and second body portions 102 and 142 are attached (FIGS. 1 and 2). In some embodiments, the clip fasteners 180 on the first body portion 102 may be identical to the clip fasteners 180 on the second body portion 142. I.e., each clip fastener 180 may be configured to connect to an identical clip fastener 180 arranged in a vertically-inverted position. As shown, the clip fasteners 180 of the first body portion 102 may be arranged in discrete, spaced-apart positions or spaced-apart relationship along the first body portion 102; similarly, the clip fasteners 180 of the second body portion 142 may be arranged in discrete, spaced-apart positions or spaced-apart relationship along the second body portion 142.

With continued reference to FIG. 8, a container door 170 may be supported by the first body portion 102 and the second body portion 142. The container door 170 may be selectively deployable to open and close the container interior 160. At least one container securing feature 192 may be provided on the first body portion 102 and/or the second body portion 142. In some embodiments, one or more container securing features 192 may be provided on each one of the first and second body portions 102 and 142, and more preferably, the container securing feature(s) 192 on the first body portion 102 may be identical to the container securing feature(s) 192 on the second body portion 142. The container securing feature or features 192 may be configured to secure the container assembly 100 in a transport vehicle (not illustrated) or a refrigerator, freezer, cooler or other storage receptacle or facility (not illustrated), for instance and without limitation. In some embodiments, at least one door lock 176 may be provided on the container door 170. The container door 170 may be selectively lockable to prevent unauthorized access to the container interior 160 by deployment of the door lock 176.

Figure 5:
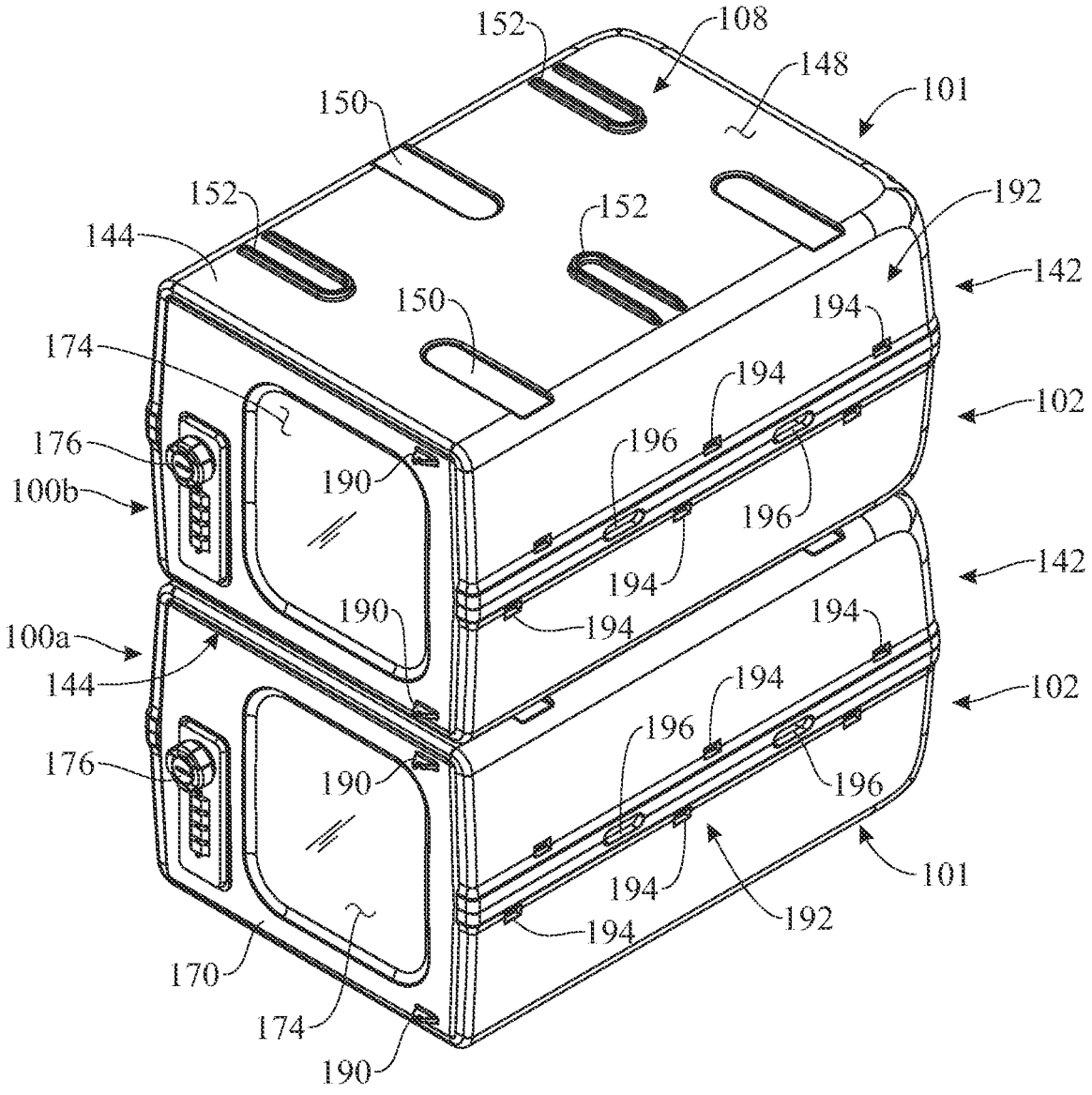
FIG. 5 presents a top front isometric view of the container assembly of FIG. 1 stacked with an identical, second container assembly.

As illustrated in FIG. 5, in some embodiments, the container assembly 100 may be stackable with one or more same container assembly 100. For simplicity, the figure shows two container assemblies 100 in a stacked configuration (stacked along vertical direction z); however, in different applications, three or more container assemblies 100 in accordance with the present disclosure may be stacked on top of each other. At least one container stabilization feature 108 may be provided on the first body portion 102 and/or the second body portion 142. In some embodiments, one or more container stabilization features 108 may be provided on each one of the first and second body portions 102 and 142, and more preferably, the container stabilization feature(s) 108 on the first body portion 102 may be identical to the container stabilization feature(s) 108 on the second body portion 142. The container stabilization features 108 may facilitate secure stacking of the container assemblies 100 on top of each other. For example, the container stabilization features 108 may be configured to prevent relative horizontal movement between the stacked container assemblies 100.

As best shown in FIG. 3, in some embodiments, the first body portion 102 and the second body portion 142 may be elongated and rectangular. In other embodiments, the first body portion 102 and the second body portion 142 may be circular, oval, elliptical, polygonal, or may have any other desirable shape. The first body portion 102 of the container assembly 100 may include a base panel 104 and one or more sidewalls extending from the base panel 104; for example, the one or more sidewalls of the first body portion 102 may include a pair of spaced-apart side panels 124 arranged opposite to one another and a rear panel 132 extending between the side panels 124. The second body portion 142 of the container assembly 100 may include a base panel 144 and one or more sidewalls extending from the base panel 144; for example, the one or more sidewalls of the second body portion 142 may include a pair of spaced-apart side panels 154 arranged opposite to one another and a rear panel 162 extending between the side panels 154. The side panels 154 and the rear panel 162 of the second body portion 142 may be configured to mate with the side panels 124 and rear panel 132 of the first body portion 102, respectively. As mentioned heretofore, in some embodiments, the first and second body portions 102, 142 may be identical to each other; in such embodiments, the rear panels 132, 162 may be identical to each other, and the pairs of side panels 124, 154 may be identical to each other.

As illustrated in FIG. 4, in some embodiments, at least one interconnecting member 138, 168 may extend between the first body portion 102 and the second body portion 142. The interconnecting member or members 138, 168 may be formed as elongated bodies configured to overlap with each one of the first and second body portions 102, 142. Each interconnecting member 138, 168 may be adhered and/or otherwise attached to the first body portion 102 and the second body portion 142. The interconnecting members 138, 168 may reinforce the connection between the first and second body portions 102 and 142.

The clip fasteners 180 are configured to facilitate secure and optionally disconnectable attachment of the second body portion 142 to the first body portion 102. In some embodiments, the clip fasteners 180 may be provided on the side panels 124 and the rear panel 132 of the first body portion 102 and on the side panels 154 and the rear panel 162 of the second body portion 142, and more preferably, on an inner side of the panels, as mentioned heretofore. In some embodiments, each clip fastener 180 on the first body portion 102 may include one of a clip retaining frame 182 and a clip 186, and each corresponding clip fastener 180 on the second body portion 142 may include the other of a clip retaining frame 182 and a clip 186. One or both of the clip retaining frame 182 and clip 186 may be slightly elastically deformable to allow the clip retaining frame 182 and clip 186 to deform allowing one another to connect, and to subsequently elastically at least partially recover an original shape, allowing the clip retaining frame 182 and clip 186 to remain connected to one another. In some embodiments, the clip 186 may be configured to insert into the clip retaining frame 182 such that the clip retaining frame 182 engages and retains the clip 186 in the clip retaining frame 182. The clip retaining frame 182 of each clip fastener 180 may have a frame opening 184. The clip 186 may have a sloped, clip flange 188 which is sized and configured to snap into the frame opening 184 of the clip retaining frame 182 in engagement of the clip 186 with the clip retaining frame 182.

Figure 7:
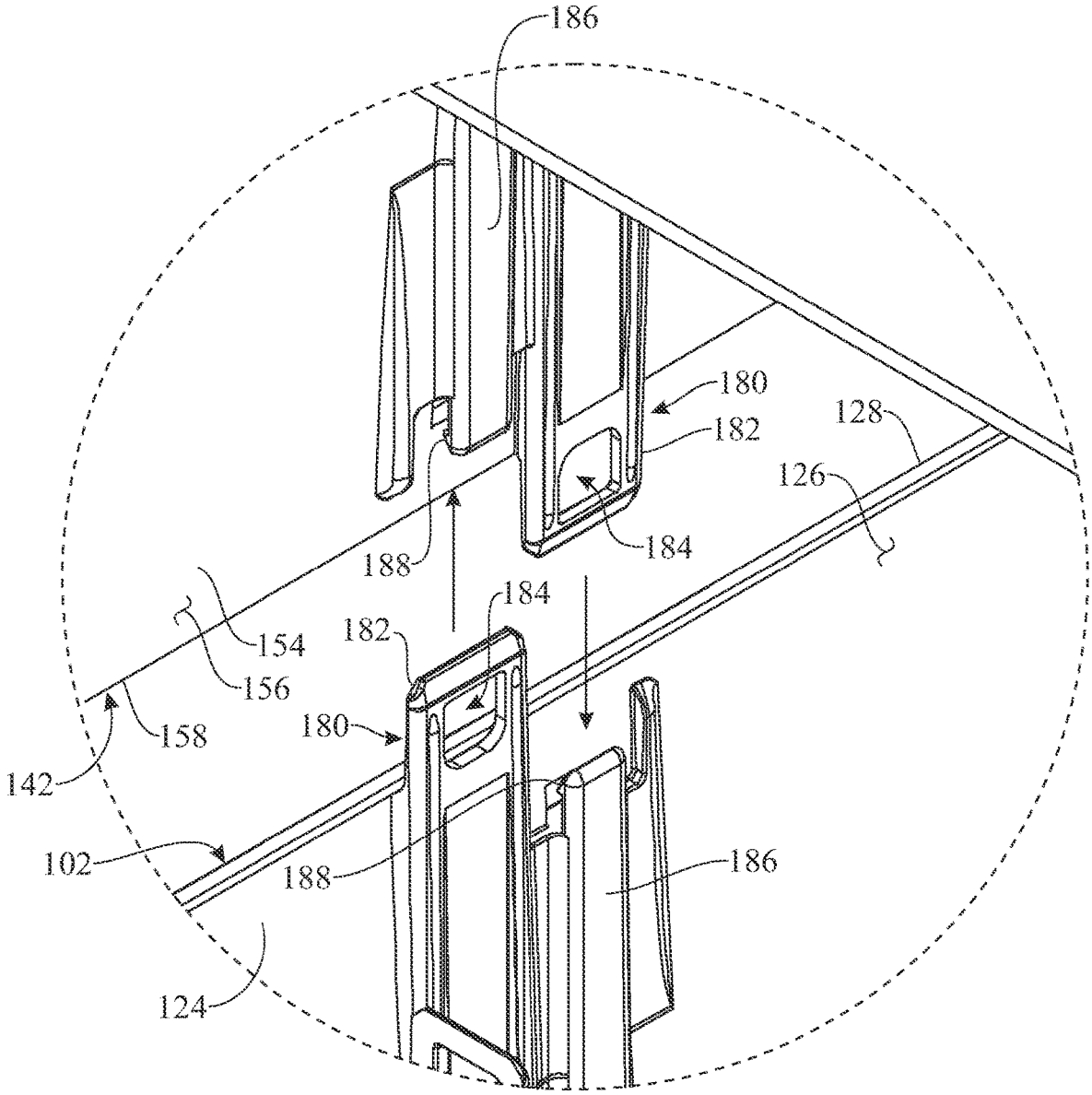
FIG. 7 presents an enlarged isometric view illustrating a clip fastener of the first body portion disengaged from a corresponding clip fastener of the second body portion of the main body of the container assembly.

As best shown in FIG. 7, in some embodiments, such as the present embodiment, each clip fastener 180 may include both a clip 186 and a clip retaining frame 182. The clip 186 and clip retaining frame 182 of each clip fastener 180 of the first body portion 102 are configured to respectively engage with the clip retaining frame 182 and clip 186 of a corresponding clip fastener 180 of the second body portion 142.

As mentioned heretofore, the clip fasteners 180 on the first body portion 102 may be identical to the clip fasteners 180 on the second body portion 142, with the identical clip fasteners 180 oriented in opposite relationship to each other for connection (together with the body portions 102, 142). In these embodiments, the clips 186 and clip retaining frames 182 of the first body portion 102 are identical to the clips 186 and clip retaining frames 182 of the second body portion 142.

As illustrated in FIG. 3, the clip retaining frame 182 and the clip 186 of each clip fastener 180 may be attached to or fabricated integrally with an interior surface 126 of each side panel 124 and/or an interior surface 134 of the rear panel 132 of the first body portion 102. The portion of the clip retaining frame 182 having the frame opening 184 may protrude upwardly beyond an upper edge 128 of each corresponding side panel 124 and an upper edge 136 of the rear panel 132. In like manner, as illustrated in FIG. 4, the clip retaining frame 182 and the clip 186 of each clip fastener 180 may be attached to or fabricated integrally with an interior surface 156 of each side panel 154 and/or an interior surface 164 (FIG. 8) on the rear panel 162 of the second body portion 142. The frame opening 184 of each clip retaining frame 182 may protrude downwardly beyond a lower edge 158 of each corresponding side panel 154 and a lower edge 166 of the rear panel 162.

Referring back to FIGS. 1 and 2, the container securing feature 192 of the container assembly 100 may include a plurality of through holes 194 formed in at least one of the first body portion 102 and the second body portion 142. The through holes 194 may be sized and configured to receive a threaded metallic cord, or other cord, strand or tie (not illustrated), hereinafter referred to generically as tie, to facilitate securement of the container assembly 100 inside the refrigerator, freezer, cooler or other storage receptacle or facility (not illustrated) and prevent theft, loss or the like and/or to vent the items inside the receptacle or facility. In some embodiments, the through holes 194 of the container securing feature 192 may be provided in both the first body portion 102 and the second body portion 142. Each through hole 194 may extend through one of the first body portion 102 and the second body portion 142, providing increased structural resistance to withstand pulling on the container assembly 100 and the tie inserted through the through hole 194. The through holes 194 may be provided in spaced-apart relationship to each other in each side panel 124 of the first body portion 102 and in each side panel 154 of the second body portion 142. In some embodiments, the through holes 194 may additionally or alternatively be provided in the rear panel 132 of the first body portion 102 and/or in the rear panel 162 of the second body portion 142.

In some embodiments, the container securing feature 192 may alternatively or additionally include a plurality of securement cutouts 196 in the first body portion 102 and/or the second body portion 142. The securement cutouts 196 may be formed by and between the side panels 124 of the first body portion 102 and the respective interfacing side panels 154 of the second body portion 142. The securement cutouts 196 may facilitate attachment of the container assembly 100 to a bracket (not illustrated) that may interface with a refrigerator rack (not illustrated), or alternatively, directly to the refrigerator rack in securement of the container in the refrigerator. In some embodiments, such as the present embodiment, the securement cutouts 196 may be formed at the junction between the first and second body portions 102 and 142, along the respective upper edges 128, 136 and lower edges 158, 166.

As illustrated in FIG. 4, the container stabilization feature 108 of the container assembly 100 may include at least one recess 110 provided in an exterior surface 106 of the base panel 104 of the first body portion 102, and at least one protrusion 112 provided on the exterior surface 106 of the base panel 104 of the first body portion 102. As illustrated in FIG. 3, at least one recess 150 may be provided in an exterior surface 148 of the base panel 144 of the second body portion 142, and at least one protrusion 152 may be provided on the exterior surface 148 of the base panel 144 of the second body portion 142. The recess or recesses 110 in the base panel 104 of the first body portion 102 may be configured to at least partially receive the respective protrusion or protrusions 152 on the base panel 144 of the second body portion 142. The protrusion 112 on the base panel 104 of the first body portion 102 may be configured to at least partially fit within the respective recess or recesses 150 on the base panel 144 of the second body portion 142. In consequence, when stacking two identical container assemblies 100*a*, 100*b* one on top of the other, as shown in FIG. 5, the recess(es) 150 and protrusion(s) 152 of the base panel 144 of the second body portion 142 of the bottom container assembly 100*a* may engage with the protrusion(s) 112 and recess(es) 110 of the base panel 104 of the first body portion 102 of the top container assembly 100*b*, thereby securing and preventing horizontal shifting of the stacked container assemblies 100*a*, 100*b* relative to one another. It should be noted that the recesses and protrusions 110 and 112 of the first body portion 102 are elongately formed along a left-to-right, transverse direction y of the main body 101, and are aligned along a perpendicular, longitudinal direction x of the main body 101, both of which contribute to maximize stability (i.e. reduce or prevent movement) along a horizontal (x-y) plane while minimizing the size of the recesses and protrusions 110 and 112 and thus allowing the exterior surface 106 of the base panel 104 of the first body portion 102 to be mostly flat, which may contribute to increase hygiene.

In preferred embodiments, the set of protrusion(s) 112 and recess(es) 110 of the base panel 104 of the first body portion 102 and the set of recess(es) 150 and protrusion(s) 152 of the base panel 144 of the second body portion 142 of each container assembly 100 may be identical to one another, for example, in the present embodiment, each set includes three recesses and three protrusions, interspersed with one another, as best shown in FIGS. 1 and 2, with the set of protrusions and recesses on the second body portion 142 being a mirror of the set of protrusions and recesses of the first body portion 102 when the body portions 102, 142 are arranged facing one another and inverted, as shown in FIGS. 1-3.

As illustrated in FIGS. 3 and 4, at least one hinge 172 may pivotally attach the container door 170 to the first body portion 102 and the second body portion 142. At least one door indentation 174 may be provided in the container door 170 for reinforcement, aesthetics, attachment thereto of a label, and/or other purposes. In some embodiments, at least one doorstop 190 may be provided on the container door 170.

Figure 6:
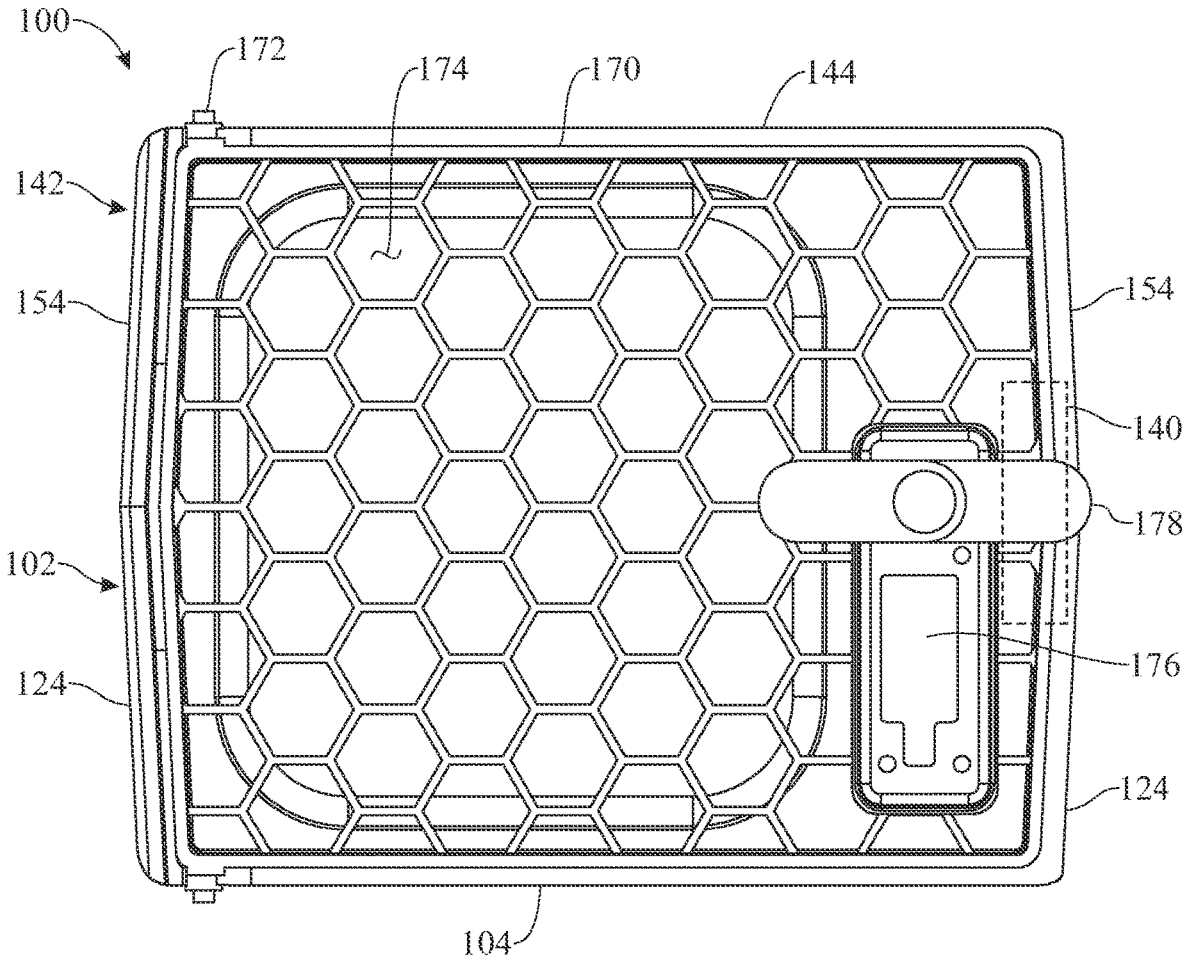
FIG. 6 presents a rear elevation view of a container door of the container assembly, attached to the main body of the container assembly, with a door latch of the door lock deployed in a locking configuration.

In some embodiments, the door lock 176 on the container door 170 may include at least one combination lock and/or at least one key-operated lock. As illustrated in FIGS. 4 and 6, the door lock 176 may include a lock latch 178. As illustrated in FIG. 6, in in a locking configuration, the lock latch 178 may be configured to engage the main body 101 of the container assembly 100 to lock the container door 170 in a closed position. In an unlocking configuration, the lock latch 178 may be configured to disengage the main body 101 to unlock and facilitate opening of the container door 170.

In the present embodiment, the lock latch 178 is more specifically configured to engage the interconnecting member 138 of the main body 101 in the locking configuration. As illustrated in FIG. 4, in some embodiments, a lock stop 140 may be provided on the interconnecting member 138. The lock latch 178 of the door lock 176 may be configured to engage the lock stop 140 in the locking configuration of the lock latch 178.

In an example of application, the container assembly 100 may be assembled by attaching the first body portion 102 to the second body portion 142 via the clip fasteners 180, to form the main body 101. This attachment may be secured by engagement of each clip 186 on the first body portion 102 or the second body portion 142 with the corresponding interfacing clip retaining frame 182 on the other of the first body portion 102 and the second body portion 142. The clip flange 188 on each clip 186 may snap into the companion frame opening 184 in each corresponding clip retaining frame 182 of each clip fastener 180. The attachment between the first and second body portions 102 and 142 may be reinforced by attachment of the interconnecting members 138, 168 to the first body portion 102 and the second body portion 142. In some embodiments, this may be accomplished using an adhesive, an elastic clip or other mechanical fastener, and/or other applicable attachment mechanism.

In some applications, the container assembly 100 may be secured inside a transport vehicle (not illustrated) to facilitate transportation of items in the container assembly 100 such as from a grocery, restaurant establishment, or catering facility to a home, office, hospital, clinic, or other location or destination. A tie (not illustrated) may be extended through the through holes 194 of the container securing feature 192 and tied or otherwise attached to a structural element in the vehicle. Additionally or alternatively, the securement cutouts 196 of the container securing feature 192 may be utilized to secure the container assembly 100 to a rack (not illustrated) inside the vehicle. The item or items may have been placed in the container interior 160 by opening the door 170 after unlocking the door lock 176. The door 170 may be secured in the closed position by locking the door lock 176.

After arrival at the desired destination, the container assembly 100 may be removed from the transport vehicle and carried into the destination building. The container assembly 100 may be placed inside a refrigerator (not illustrated) or freezer for preservation of perishable food, medicine, or other perishable items placed in the container interior 160. The through holes 194 and/or the securement cutouts 196 of the container securing feature 192 may be utilized to secure the container assembly 100 inside the refrigerator, as was heretofore described. The door lock 176 may prevent unauthorized access to the container interior 160 to prevent theft or unauthorized consumption of the items placed therein.

As illustrated in FIG. 5, in some applications, two or more container assemblies 100 may be stacked on top of each other in the transport vehicle or in the refrigerator or freezer. The protrusions 112 (FIG. 2) on the exterior surface 106 of the top container assembly 100*b* may be inserted into the respective companion recesses 150 in the exterior surface 148 of the bottom container assembly 100*a*. Likewise, the recesses 110 (FIG. 2) in the exterior surface 106 of the top container assembly 100*b* may receive the respective companion protrusions 152 on the exterior surface 148 of the bottom container assembly 100*a*. The container stabilization feature 108 may prevent inadvertent sideways shifting or sliding of the stacked container assemblies 100 during transport in the transport vehicle or in the refrigerator or freezer.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A container assembly configured to contain and store or transport items in an organized and secure manner, comprising:

a first body portion and a second body portion mountable to the first body portion, each one of the first body portion and second body portion comprising a respective plurality of clip fasteners, wherein each clip fastener of the plurality of clip fasteners of the first body portion is configured to elastically engage a respective clip fastener of the plurality of clip fasteners of the second body portion, wherein the clip fasteners of the first body portion are arranged in spaced-apart configuration along an inner side of one or more sidewalls of the first body portion, and the clip fasteners of the second body portion are arranged in spaced-apart configuration along an inner side of one or more sidewalls of the second body portion, and further wherein said each clip fastener of the plurality of clip fasteners of the first body portion comprises a clip and a clip retaining frame, and said respective clip fastener of the plurality of clip fasteners of the second body portion comprises a clip retaining frame and a clip, wherein the clip and clip retaining frame of said each clip fastener of the plurality of clip fasteners of the first body portion is configured to engage, respectively, with the clip retaining frame and clip of the respective clip fastener of the plurality of clip fasteners of the second body portion, wherein the first body portion is identical to the second body portion and the plurality of clip fasteners of the first body portion are identical to the plurality of clip fasteners of the second body portion; and a container door; wherein the container assembly is configured to adopt an assembled configuration in which the first body portion is mounted on the second body portion and secured to the second body portion by engagement between the plurality of clip fasteners of the first body portion and the plurality of fasteners of the second body portion, with a container interior formed by and between the first body portion and the second body portion, the container interior defined by said inner sides of said one or more sidewalls of the first and second body portions and configured to receive and contain at least one item, the plurality of clip fasteners of the first and second body portions arranged at the container interior, and further in which the container door is attached to the first and second body portions and is pivotable with respect to the first and second body portions between open and closed positions respectively allowing and preventing access to the container interior.

2. The container assembly of claim 1, wherein a clip flange of the clip and a frame opening of the clip retaining frame of said each clip fastener of the plurality of clip fasteners of the first body portion is configured to engage, respectively, with a frame opening of the clip retaining frame and a clip flange of the clip of the respective clip fastener of the plurality of clip fasteners of the second body portion in the assembled configuration of the container assembly.

3. The container assembly of claim 1, further comprising at least one container securing feature on at least one of the first body portion or the second body portion, the at least one container securing feature configured to engage with an external structure for securing container assembly to the external structure.

4. The container assembly of claim 3, wherein the container securing feature comprises a plurality of through holes in at least one of the first body portion or the second body portion.

5. The container assembly of claim 4, wherein the plurality of through holes are provided in both the first body portion and the second body portion.

6. The container assembly of claim 3, wherein the container securing feature comprises a plurality of securement cutouts formed at a junction between the first body portion and the second body portion in the assembled configuration.

7. The container assembly of claim 1, wherein the container assembly is stackable with an identical, second container assembly to adopt a stacked configuration.

8. The container assembly of claim 7, further comprising a container stabilization feature provided on at least one of the first body portion r the second body portion, wherein the container stabilization feature at least partially blocks a relative horizontal movement between the container assembly and second container assembly in the stacked configuration.

9. The container assembly of claim 8, wherein the container stabilization feature comprises one or more protrusions formed on one of a base panel of the first body portion and a base panel of the second body portion, and one or more recesses formed on the other of the base panel of the first body portion and the base panel of the second body portion, wherein, in the assembled configuration of the container assembly, each protrusion is vertically aligned with a respective recess, and further wherein, in the stacked configuration of the container assembly and second container assembly, the base panel of the first body portion of the container assembly is stacked on the base panel of the second body portion of the second container assembly and the one or more protrusions and recesses of the base panels are engaged blocking a relative horizontal movement between the stacked container assembly and second container assembly.

10. The container assembly of claim 8, wherein the container stabilization feature comprises one or more protrusions and one or more recesses formed on a base panel of the first body portion, and one or more recesses and one or more protrusions formed on a base panel of the second body portion, wherein, in the assembled configuration of the container assembly, each protrusion of the base panel of the first body portion is vertically aligned with a respective recess of the base panel of the second body portion and each recess of the base panel of the first body portion is vertically aligned with a respective protrusion of the base panel of the second body portion, and further wherein, in the stacked configuration of the container assembly and second container assembly, the base panel of the first body portion of the container assembly is stacked on the base panel of the second body portion of the second container assembly, and each recess and each protrusion of the base panel of the first body portion of the container assembly is respectively engaged with a respective protrusion and a respective recess of the base panel of the second body portion of the second container assembly blocking relative horizontal movement between the stacked container assembly and second container assembly.

11. The container assembly of claim 1, wherein each of the first and second body portions comprises a base panel, and further wherein the respective one or more sidewalls of each one of the first and second body portions comprise a pair of spaced-apart side panels extending from the base panel and a rear panel extending from the base panel between the side panels, and further wherein the side panels and the rear panel of the second body portion are configured to mate with the side panels and rear panel of the first body portion.

12. The container assembly of claim 1, further comprising one or more interconnecting members extending between the first body portion and the second body portion, each interconnecting member formed as a separate part and attached to the first and second body portions in the assembled configuration of the container assembly.

13. The container assembly of claim 12, wherein the container door may include a door lock comprising a lock latch, wherein the lock latch is configured to engage one of the one or more interconnecting members in a locking configuration to lock the container door in a closed position, and is further configured to disengage the interconnecting member in an unlocking configuration to unlock the container door.

* * * * *